US007201710B2

(12) United States Patent
Kuo

(10) Patent No.: US 7,201,710 B2
(45) Date of Patent: Apr. 10, 2007

(54) CABLE POSITIONING ASSEMBLY FOR CONNECTING CABLE AND END ROD USED IN WEIGHT LIFTING EXERCISER

(76) Inventor: Yung-Pin Kuo, No. 55, Alley 121, Lane 175, Kuo Shen Rd., Chang Hwa City (TW)

( * ) Notice: Subject to any disclaimer, the term of this patent is extended or adjusted under 35 U.S.C. 154(b) by 683 days.

(21) Appl. No.: 10/717,445

(22) Filed: Nov. 21, 2003

(65) Prior Publication Data

US 2005/0113217 A1 May 26, 2005

(51) Int. Cl.
*A63B 21/00* (2006.01)

(52) U.S. Cl. ..... 482/102; 482/99; 482/93

(58) Field of Classification Search ..... 482/104–108, 482/102, 99, 93, 98, 148
See application file for complete search history.

(56) References Cited

U.S. PATENT DOCUMENTS 5,184,992 A * 2/1993 Banks ..... 482/104
5,211,614 A * 5/1993 Henes ..... 482/102
5,549,531 A * 8/1996 Campbell ..... 482/106
6,010,436 A * 1/2000 Obery et al. ..... 482/93
6,231,486 B1 * 5/2001 Lee ..... 482/101

* cited by examiner

*Primary Examiner*—Jerome Donnelly
(74) *Attorney, Agent, or Firm*—Rosenberg, Klein & Lee

(57) ABSTRACT

A cable positioning assembly for a weight lifting exerciser includes an oval anti-impact member mounted to a cable which has one end thereof connected to the weights and the other end of the cable reeves through pulleys connected to the main frame of the weight lifting exerciser. The second end of the cable is connected to an end rod which is connected to a pulling handlebar. A passage is defined longitudinally through the anti-impact member and a flexible tube is securely engaged with the passage. The flexible tube includes two enlarged end flanges extending radially from two ends of the flexible tube and the two enlarged end flanges are engaged with two openings defined by the passage in the anti-impact member.

7 Claims, 5 Drawing Sheets

CABLE POSITIONING ASSEMBLY FOR CONNECTING CABLE AND END ROD USED IN WEIGHT LIFTING EXERCISER

FIELD OF THE INVENTION

The present invention relates to a weight lifting exerciser, and more particularly, to an olive-shaped member with an integral tube extending therethrough and the cable is fixed engaged with the tube.

BACKGROUND OF THE INVENTION

A conventional weight lifting exerciser "A" is shown in FIG. 1 and includes a main frame with two guide rods 5 and weights 10 are movably mounted to the two rods 5. A cable system 20 including at least one operation cable 21 is connected to the weights 10 and reeves through several pulleys 6 and is connected to an end rod 22 as shown in FIG. 2. The end rod 22 is connected to a pulling handlebar 30 as disclosed in FIG. 1. A cable positioning assembly "B" as disclosed in FIG. 2 and includes a anti-impact ball 23 and the cable 21 extends through a passage 231 defined through the ball 23 and is connected to the end rod 22. A seal 24 is mounted to a sheath on the cable 21 and seals the opening in the first end of the passage 23. A washer 25 is mounted to the sheath and clamped between the end rod 22 and the ball 23 so as to seal the opening in the second end of the passage 23. Nevertheless, during operating the exerciser "A", the anti-impact ball 23 in suffered frequent impact with the pulley when the cable 21 is pulled to lower the weights 10. It is experienced that the seal 24 is often disengaged from the ball 23 as shown in FIG., 2-1, and/or the ball 23 is shifted on the sheath of the cable 21 and the seal 24 is forced into the passage 231 as shown in FIG. 3. Both of the situations makes the anti-impact ball 23 become useless.

The present invention intends to provide a cable positioning assembly including an olive-shaped anti-impact member with a tube secured in the anti-impact member and the cable is secured in the tube. The combination of the anti-impact member and the tube is so strong that the anti-impact member is not moved during the operation of the exerciser.

SUMMARY OF THE INVENTION

The present invention relates to a weight lifting exerciser and comprises a main frame with at least one guide rod and weights are movably mounted to the at least one guide rod. A cable system has a cable which has one end thereof connected to the weights and the other end of the cable reeves through pulleys connected to the main frame and connected to an end rod which is connected to a pulling handlebar.

A cable positioning assembly is mounted to the cable and connected to the end rod. The cable positioning assembly includes an anti-impact member which has a passage defined longitudinally therethrough. A flexible tube is securely engaged with the passage and includes two enlarged end flanges extending radially from two ends of the flexible tube. The two enlarged end flanges are engaged with two openings defined by the passage in the anti-impact member.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 2-1 is a cross sectional view showing the seal of the conventional cable positioning assembly is disengaged from the anti-impact ball;

DETAILED DESCRIPTION OF THE PREFERRED EMBODIMENT

Figure 1:
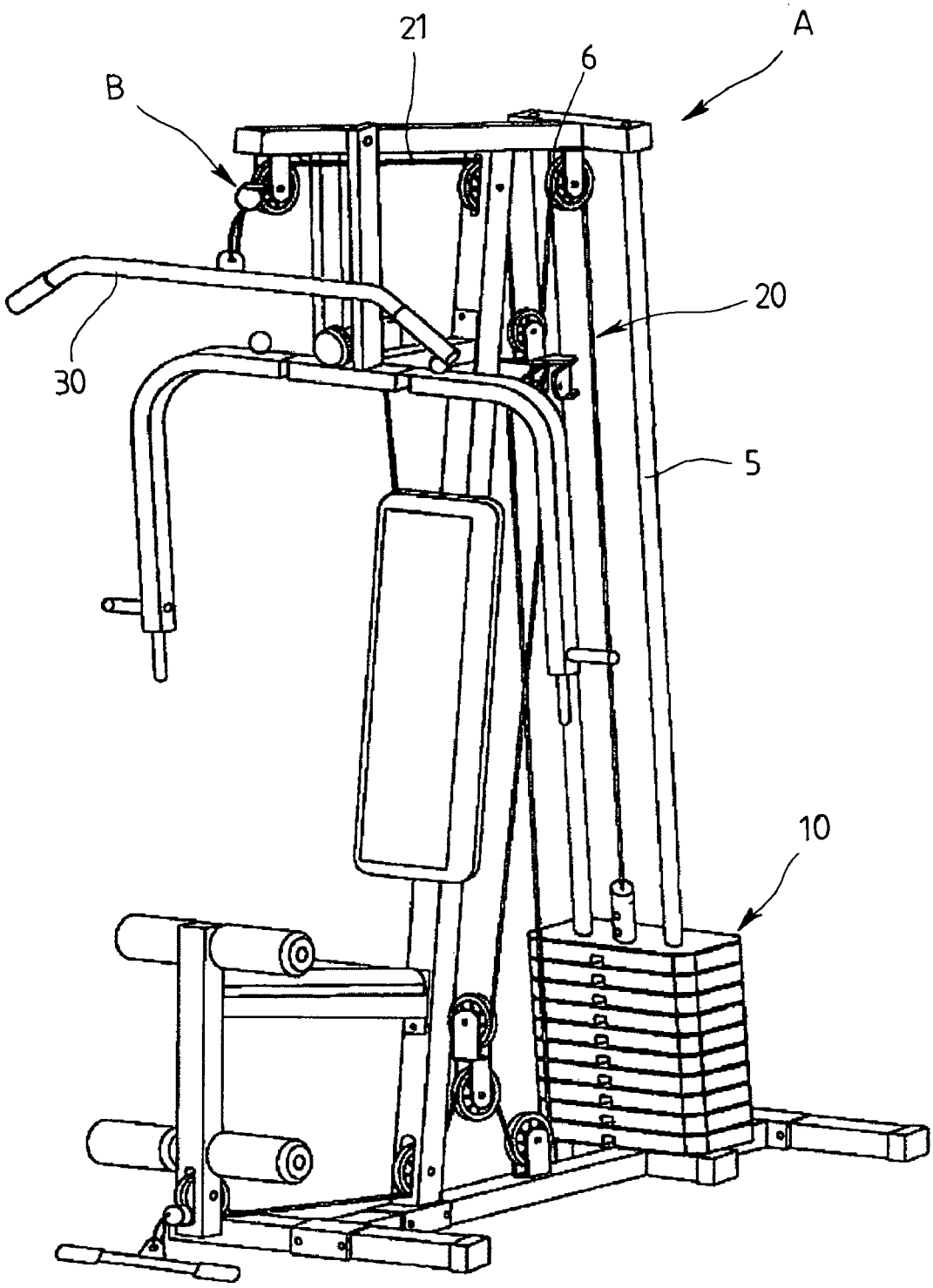
FIG.1 PRIOR ART
FIG. 1 is a perspective view to show a conventional weight lifting exerciser.
Figure 2:
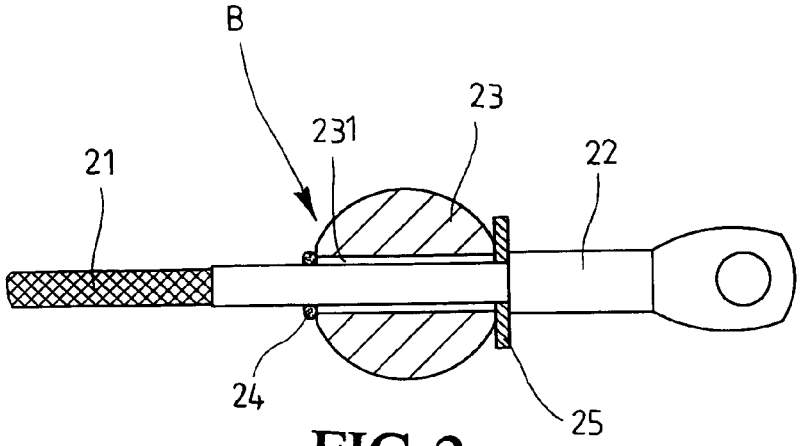
FIG.2 PRIOR ART
FIG. 2 is a cross sectional view showing the conventional cable positioning assembly connected with an end rod.
Figures 1, 2:
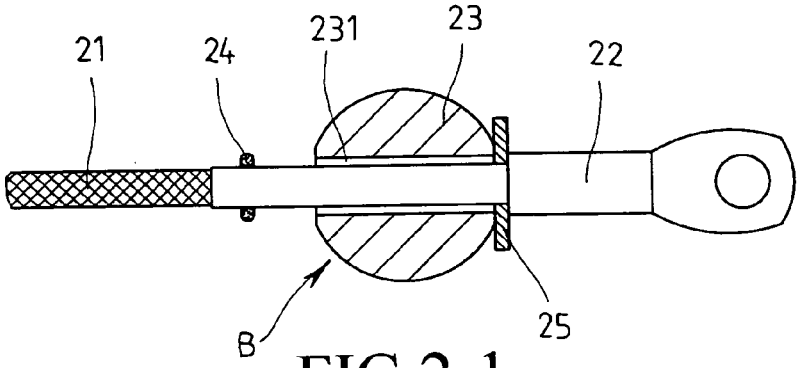
FIG.2-1 PRIOR ART
Figure 3:
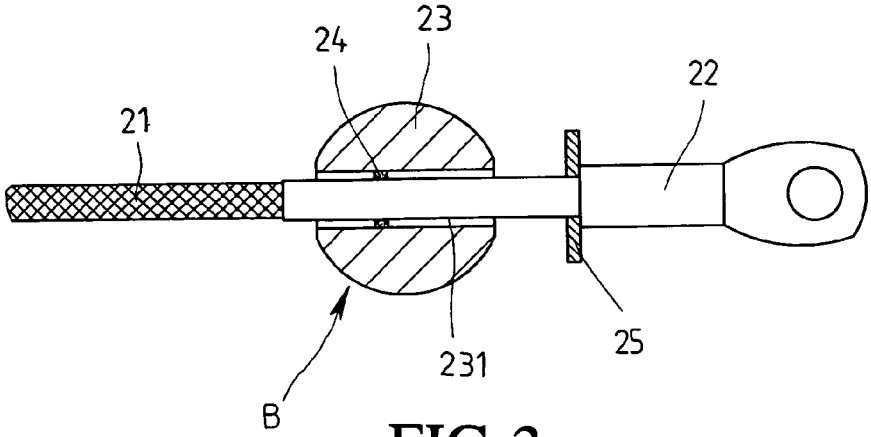
FIG.3 PRIOR ART
FIG. 3 is a cross sectional view showing the anti-impact ball is shifted and the washer is moved into the passage of the anti-impact ball.
Figure 4:
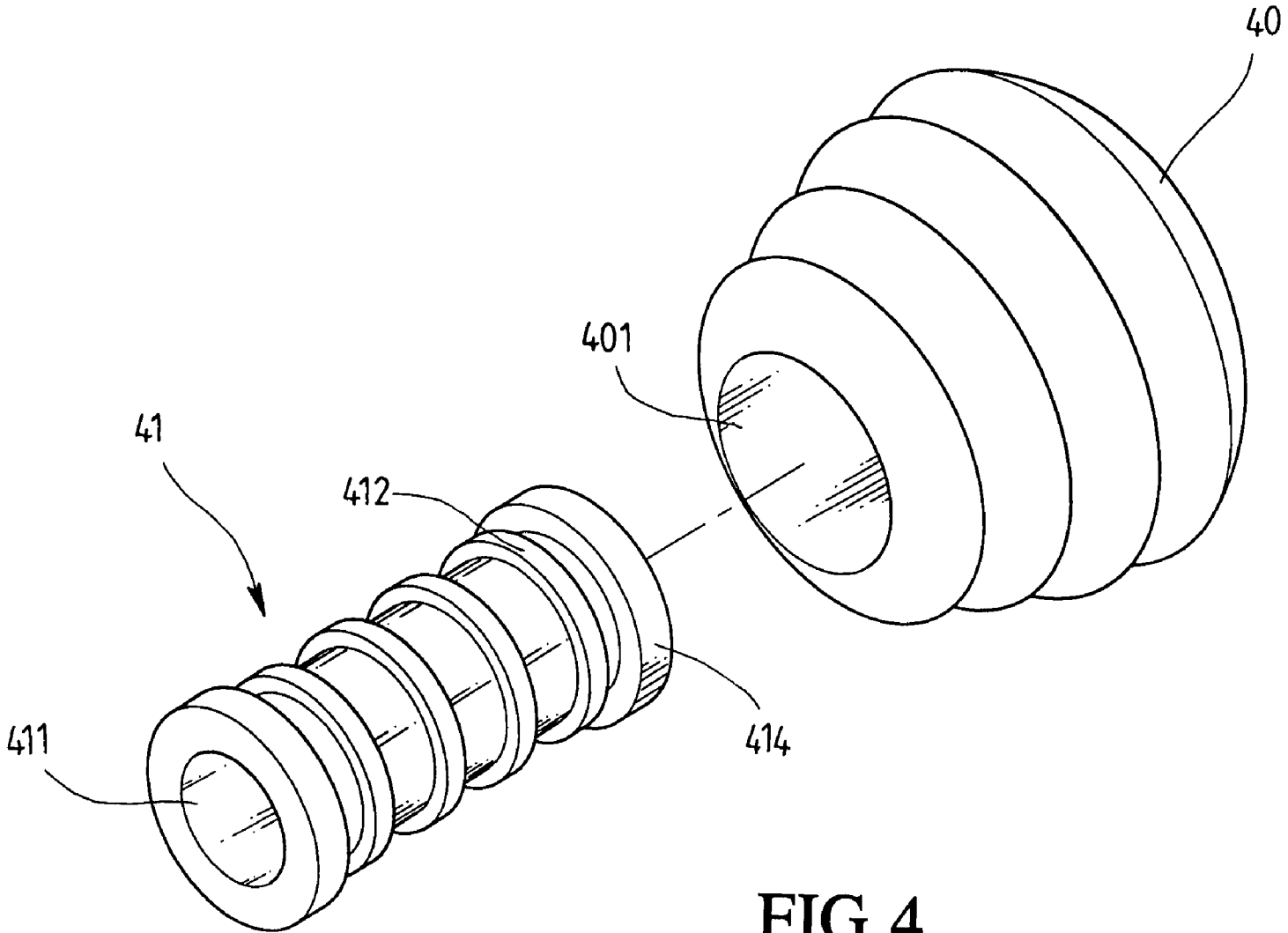
FIG. 4 is an exploded view to show the cable positioning assembly of the present invention.
Figure 5:
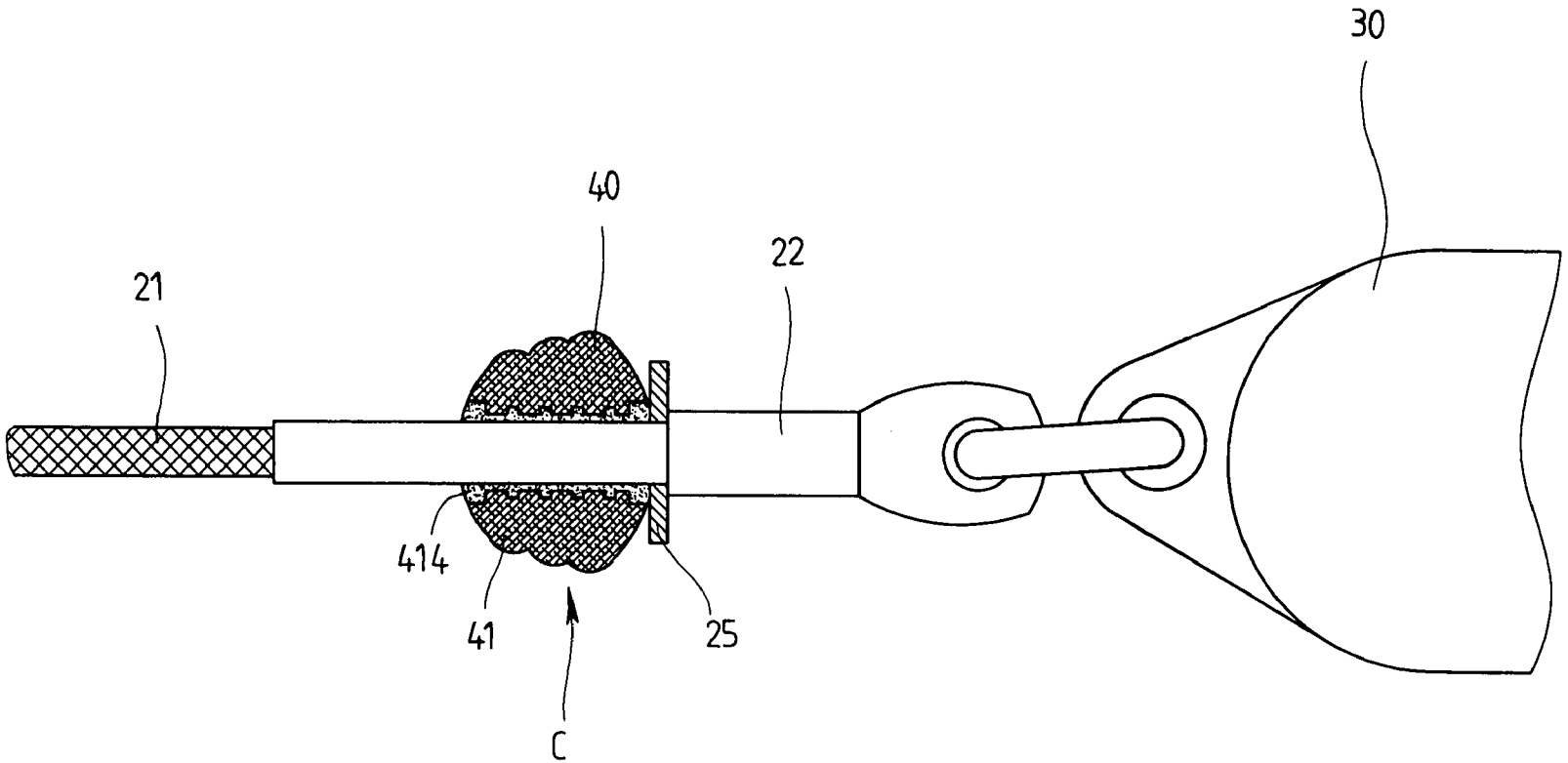
FIG. 5 is a cross sectional view showing the cable positioning assembly of the present invention connected to an end rod.
Figure 6:
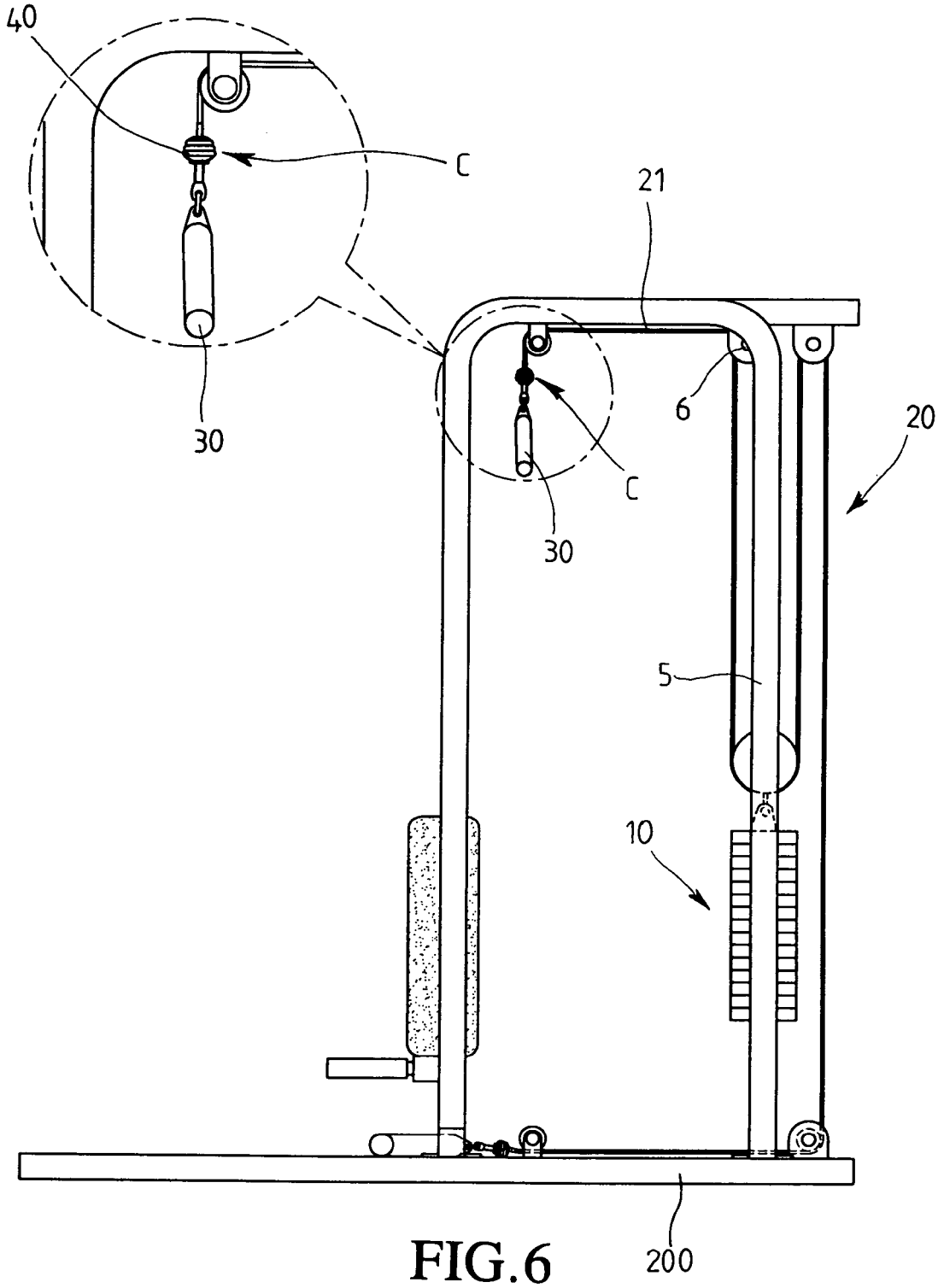
FIG. 6 shows a side view of a weight lifting exerciser with the cable positioning assembly of the present invention.

Referring to FIGS. 4 to 6, the weight lifting exerciser that is equipped with the cable positioning assembly of the present invention comprises a main frame 200 and at least one guide rod 5 is connected to the main frame 200 and weights 10 are movably mounted to the at least one guide rod 5. A cable system 20 including a cable 21 which has one end thereof connected to the weights 10 and the other end of the cable 21 reeves through pulleys 6 located at different position of the main frame 200. The second end of the cable 21 is connected to an end rod 22 which is connected to a pulling handlebar 30.

A cable positioning assembly "C" is mounted to the cable 21 and connected to the end rod 22. The cable positioning assembly "C" includes an anti-impact member 40 which has a passage 401 defined longitudinally therethrough. The anti-impact member 40 includes an oval body and includes several annular rings of different diameters on the outer periphery thereof. The anti-impact member 40 may be made of Nylon. A flexible tube 41 having a through hole 411 is securely engaged with the passage 401 and includes two enlarged end flanges 414 extending radially from two ends of the flexible tube 41. The two enlarged end flanges 414 are engaged with two openings defined by the passage in the anti-impact member 40. The cable 21 extends through the through hole 411. The flexible tube 41 further has a plurality of engaging flanges 412 extending radially from an outer periphery thereof, and the engaging flanges 412 are securely engaged an inner periphery of the passage 401 of the anti-impact member 40. It is to be noted that the flexible tube 41 can also be integrally formed with the anti-impact member 40, and the anti-impact member 40 and the flexible tube 41 may be made to have different hardness. The flexible tube 41 can be made of Polyurethane Silicone or Silicone. A washer 25 is clamped between the anti-impact member 40 and the end rod 22 as seen in the conventional cable positioning assembly.

The cable positioning assembly can be used on different applications of exercisers and the anti-impact member 40 will not move under frequent impact condition.

While we have shown and described the embodiment in accordance with the present invention, it should be clear to those skilled in the art that further embodiments may be made without departing from the scope of the present invention.

What is claimed is:

1. A weight lifting exerciser comprising:

a main frame and at least one guide rod connected to the main frame and weights being movably mounted to the at least one guide rod, a cable system having a cable having one end thereof connected to the weights and the other end of the cable reeving through pulleys connected to the main frame and connected to an end rod which is connected to a pulling handlebar, and a cable positioning assembly mounted to the cable and connected to the end rod, the cable positioning assembly including an anti-impact member which has a passage defined longitudinally therethrough, a flexible tube securely engaged with the passage and including two enlarged end flanges extending radially from two ends of the flexible tube, the two enlarged end flanges engaged with two openings defined by the passage in the anti-impact member.

2. The exerciser as claimed in claim 1, wherein the anti-impact member includes an oval body and the flexible tube has a plurality of engaging flanges extending radially from an outer periphery thereof, the engaging flanges securely engaged an inner periphery of the passage of the anti-impact member.

3. The exerciser as claimed in claim 1, wherein the anti-impact member is made of Nylon.

4. The exerciser as claimed in claim 1, wherein the flexible tube is integrally formed with the anti-impact member.

5. The exerciser as claimed in claim 1, wherein the anti-impact member and the flexible tube are made to have different hardness.

6. The exerciser as claimed in claim 1, wherein the flexible tube is made of Polyurethane Silicone.

7. The exerciser as claimed in claim 1, wherein the flexible tube is made of Silicone.

* * * * *